United States Patent [19]

Wilson

[11] Patent Number: 4,756,262

[45] Date of Patent: Jul. 12, 1988

[54] MULTI-NEEDLE SEWING MACHINE

[75] Inventor: Alexander M. Wilson, Mirfield, England

[73] Assignee: Sewtec Limited, Dewsbury, England

[21] Appl. No.: 74,950

[22] Filed: Jul. 17, 1987

[51] Int. Cl.[4] ..... D05B 27/00

[52] U.S. Cl. ..... 112/304; 112/163

[58] Field of Search ..... 112/304, 163

[56] References Cited

U.S. PATENT DOCUMENTS

| | | | |
|---|---|---|---|
| 3,580,198 | 5/1971 | Teed et al. | 112/30 X |
| 4,417,535 | 11/1983 | Hannemann | 112/304 |
| 4,512,269 | 4/1985 | Bowditch | 112/304 |
| 4,660,486 | 4/1987 | Arbter | 112/304 |

*Primary Examiner*—Ronald Feldbaum

*Attorney, Agent, or Firm*—Henry Sternberg; Bert J. Lewen

[57] ABSTRACT

A multi-needle sewing machine has a workpiece feed mechanism which includes first and second side supports located to opposite ends of the needle bar. A plurality of shafts extend between the side supports at locations spaced from the front region progressively rearwards towards the rear region of those supports. A plurality of transversely spaced endless belts pass around front and rear rollers rotatably mounted on foremost and rearmost ones of the shafts. Intermediate shafts carry respective front and rear guide rollers which guide an upper run of the conveyor belt to lie adjacent to a lower run of that belt and below the needle bar. The belts are driven so that the lower runs thereof travel from the front towards the rear of the side supports.

5 Claims, 3 Drawing Sheets

MULTI-NEEDLE SEWING MACHINE

FIELD OF THE INVENTION

This invention relates to a multi-needle sewing machine, and particularly to the type of machine having a feed table, with a plurality of needle holes therein, a needle bar, a plurality of needles mounted on said needle bar, means for effecting vertical reciprocatory movement of said needle bar relative to said feed tables, a stitch forming mechanism beneath said feed table and cooperable with said needles to form stitches, and thread feed means for feeding threads to said needles and to said stitch-forming mechanism.

BACKGROUND OF THE INVENTION

Machines of the aforesaid type have incorporated various types of mechanism for feeding the workpiece between the needle bar and stitch-forming mechanism. In one such arrangement reciprocable feed-dogs are incorporated into the feed table, the feed-dogs engaging the lower surface of the workpiece in order to feed this through the machine. This limits the degree of adjustability of the needles on the needle bar and thus introduces limitations into the use of the machine. In another arrangement the needle bar is capable of movement from the front towards the back of the machine while the needles penetrate the workpiece, the needle bar returning to its forward position when the needles are lifted out of the workpiece. This walking action of the needle bar effects the necessary workpiece movement. The drive to the needle bar is necessarily complex in this arrangement, and it is well known that skip stitches can occur.

Accordingly, it is an object of this invention to provide an improved workpiece feed mechanism for use in a multi-needle sewing machine as aforesaid.

DESCRIPTION OF THE INVENTION

In accordance with the invention an improved workpiece feed mechanism has transversely spaced first and second side supports, located respectively beyond opposite ends of the needle bar of the sewing machine, a first shaft extending between said side supports at a front region thereof, second, third, fourth and fifth shafts each extending between said side supports parallel to said first shaft, each of said second, third, fourth and fifth shafts being located sequentially further from said front region of said side supports and closer to a rear region of said side supports, a plurality of transversely spaced endless belts each having an upper and a lower run, the lower run lying adjacent to the surface of the feed table of the sewing machine, and for each belt a front return roller rotatably mounted on said first shaft and engaging the inner surface of said belt, a support roller rotatably mounted on said second shaft and engaging the inner surface of said upper and lower runs of said belt, a front guide roller rotatably mounted on said third shaft and lying in front of said needle bar, a rear guide roller rotatably mounted on said fourth shaft and lying behind said needle bar, a rear return roller mounted on said fifth shaft and engaging the inner surface of said belt, said front and rear guide rollers engaging the outer surface of the upper run of said belt to guide said upper run to lie adjacent to the lower run and below said needle bar, and drive means for driving said belts so that the lower runs thereof travel from the front towards the rear of said side supports.

The belt feed system according to the invention gives positive workpiece control at all times, and it is found that skip stitches are virtually eliminated. The system is capable of maintaining such control at high throughput rates, for example at speeds of up to two thousand stitches per minute.

Preferably each of said side supports has a front section and a rear section, and means pivoting said front and rear sections together for pivotal movement about the axis of said second shaft, and said first shaft extends between said front sections of said side supports, said third, fourth and fifth shafts extend between said rear sections of said side supports, and means are provided for effecting said pivotal movement.

This arrangement enables the belts to be extended for a significant distance in front of the needles in order that the workpiece is positively controlled well before it reaches the needle area. However, access to the needle area can be facilitated by raising the front sections of the side supports. This raising also facilitates initial loading of the workpiece for passage through the machine.

Desirably at least one of said endless belts, together with its associated front return roller, support roller, front guide roller, rear guide roller and rear return roller is transversely adjustable between said first and second side supports.

It is common for needle bars to provide a multiplicity of possible needle locations, only selected ones of which are occupied by needles according to the stitching pattern required from the machine. By making each belt arrangement transversely adjustable between the side supports it will be appreciated that the belts may be adjusted to accommodate any selected pattern of needle settings.

DETAILED DESCRIPTION OF PREFERRED EMBODIMENT

Figure 1:
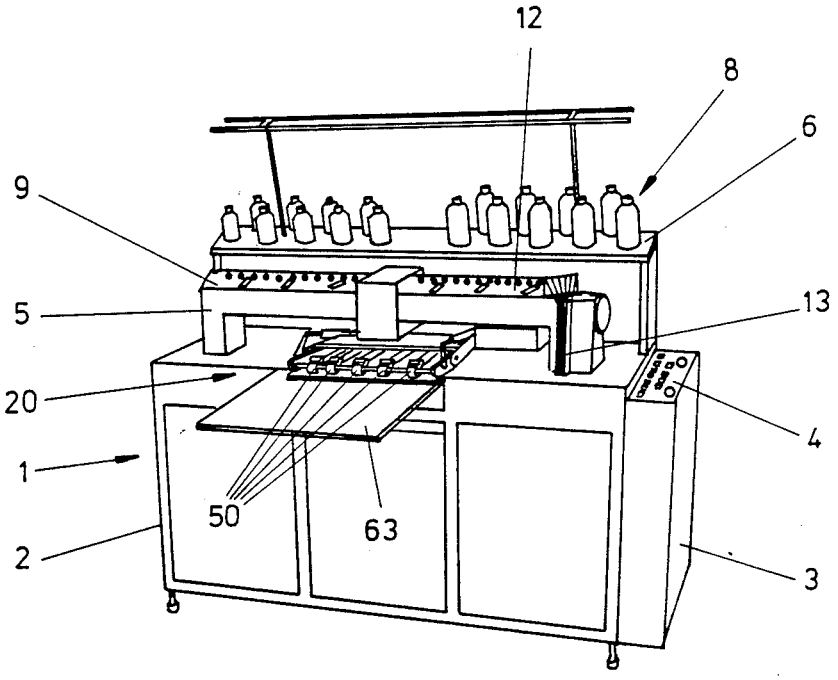
FIG. 1 is a front perspective view of a multi-needle sewing machine according to the invention.
Figure 2:
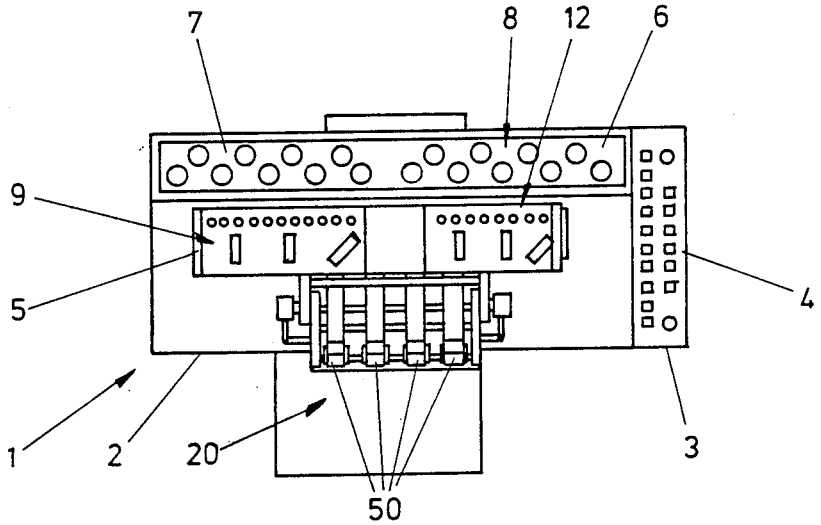
FIG. 2 is a plan view of the machine of FIG. 1.
Figure 3:
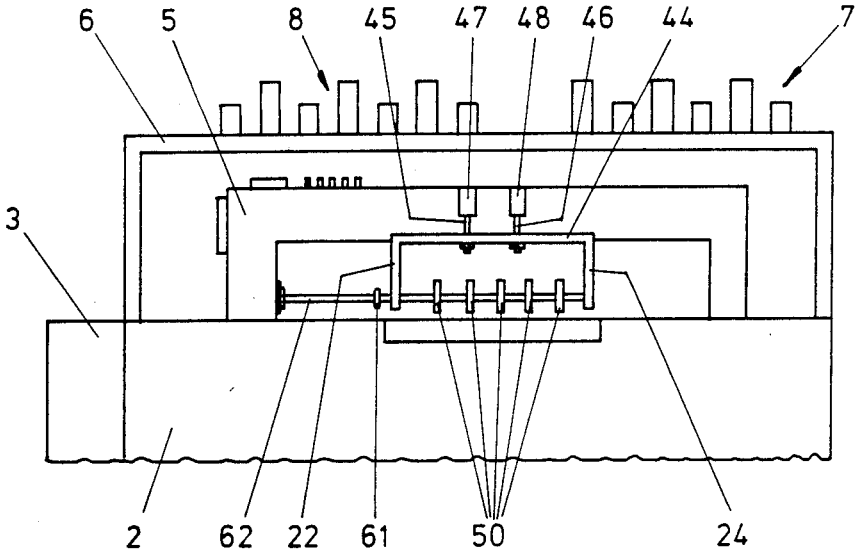
FIG. 3 is a rear elevation of the machine of FIG. 1.

FIGS. 1 to 3 of the drawings show a multi-needle sewing machine indicated generally at 1. The machine includes a base cabinet 2 incorporating drive mechanism, and an electronic control unit 3 with a console 4 mounted at one end of the cabinet. A bridge 5 is upstanding from the top of the cabinet, and a table 6 extends above the level of, and behind, the bridge 5.

Figure 6:
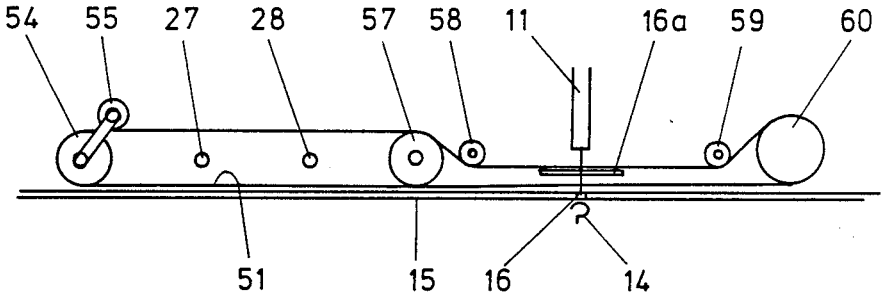
FIG. 6 is a section taken on the line VI—VI of FIG. 4.

The table has two groups of upwardly projecting spindles, a left hand group for supporting bobbins such as 7 and a right hand group for supporting bobbins such as 8. Thread from required ones of the bobbins 7 is fed through a conventional series of thread tensioners and guides indicated schematically at 9 on the upper surface of the bridge 5 and passes into a centre section 10 of the bridge. The threads are led downwardly through further guides within the bridge to the needles of a needle bar 11 located below the bridge. Threads from selected ones of the bobbins 8 are fed through a further series of thread tensioners and guides indicated schematically at 12 on the upper surface of the bridge into vertically extending guides 13 and thence into the cabinet 2. Within the cabinet the threads pass through further guides to conventional thread loopers 14 (FIG. 6) arranged under the needle bar and beneath the feed table 15 formed by the top of the cabinet 2. The feed table is formed with needle holes 16 corresponding to the positions of the needles in the needle bar, and a presser or stripper foot 16*a* is located above the region of the table. The loopers 14 are driven in synchronism with the needles by a conventional drive system familiar to those skilled in the art, drive transmission to the loopers being enclosed wholly within the cabinet 2, and the drive mechanism to the needle bar being partly housed within the cabinet 2 and partly within the bridge 5. The drive is such that the needle bar is vertically reciprocated and the loopers are synchronised with the needle bar to form stitches when the needles are in their lower positions. Thus far, the apparatus may be substantially conventional.

The invention is concerned with the feed mechanism used in the machine, and indicated generally as 20. The feed mechanism has transversely spaced first and second side supports, the first side support comprising a front section 21 and rear section 22, and the second side support comprising a front section 23 and rear section 24. First and second shafts 25, 26 extend between the front sections 21 and 23 of the side supports at, respectively, the front and rear regions of those sections. In addition, bars 27, 28 parallel to the shafts 25, 26 join the sections 21 and 23 in order to hold these rigidly in parallel spaced relationship. Third and fourth shafts 29, 30 extend between the rear sections 22 and 24 of the side supports, the fourth shaft 29 being located close to the front region of the rear sections, and the fourth shaft 30 located closer to the rear region of these sections. Spaced even further to the rear of the sections 22, 24 is a fifth shaft 31 which is journalled for rotation in bearings 32, 33 in the sections 22, 24 respectively. Additional parallel bars such as 34 may also extend between the sections 22 and 24 to assist in holding these in spaced parallel relationship. The front sections 21, 23 are pivotally mounted on their respective rear sections 22, 24 about the axis of the second shaft 26. Pneumatic ram means 35 are associated with the first side support and comprise a cylinder 36 pivotally mounted on a bracket 37 secured to the rear section 22 and a piston 38 pivotally mounted on a bracket 39 secured to the front section 21. Similar pneumatic ram means 40 extend between the front and rear sections 23, 24 of the second side support.

The rear sections 22 and 24 each have an upward extension 41, 42 which are bolted as at 43 to opposite ends of a support bar 44 to which are secured pistons 45, 46 of two pneumatic rams, the cylinders 47 and 48 of which are secured to the rear of the bridge 5. The whole of the feed assembly is thus mounted from the bridge 5 and may be raised and lowered with respect to the bridge by operation of the rams.

Figure 4:
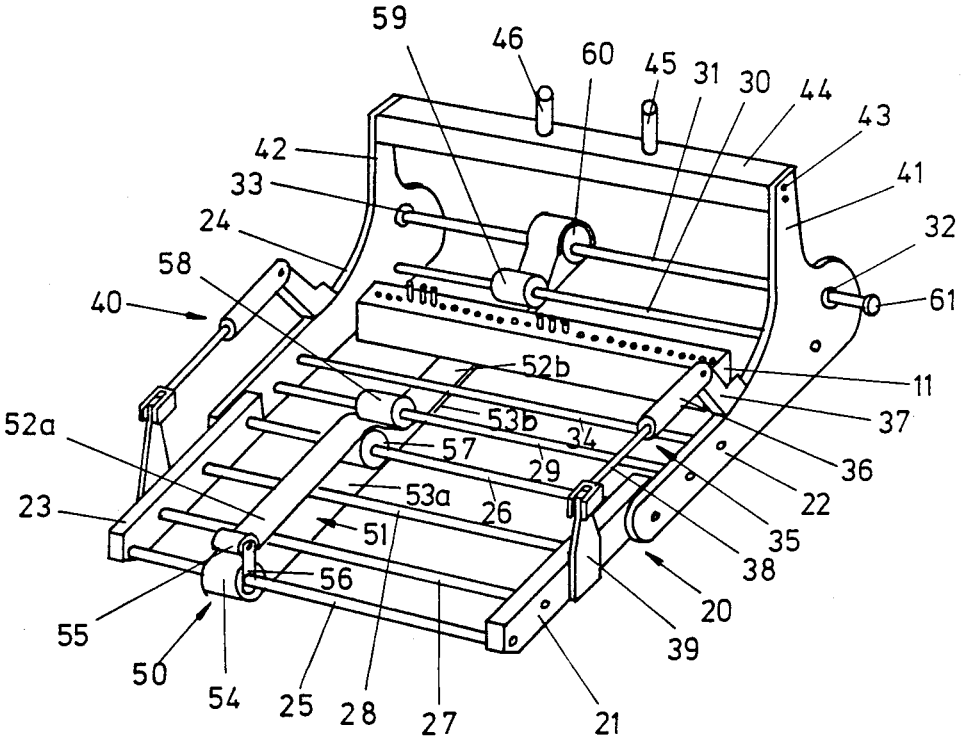
FIG. 4 is an enlarged detail view of a workpiece feed mechanism incorporated in the machine of FIG. 1.
Figure 5:
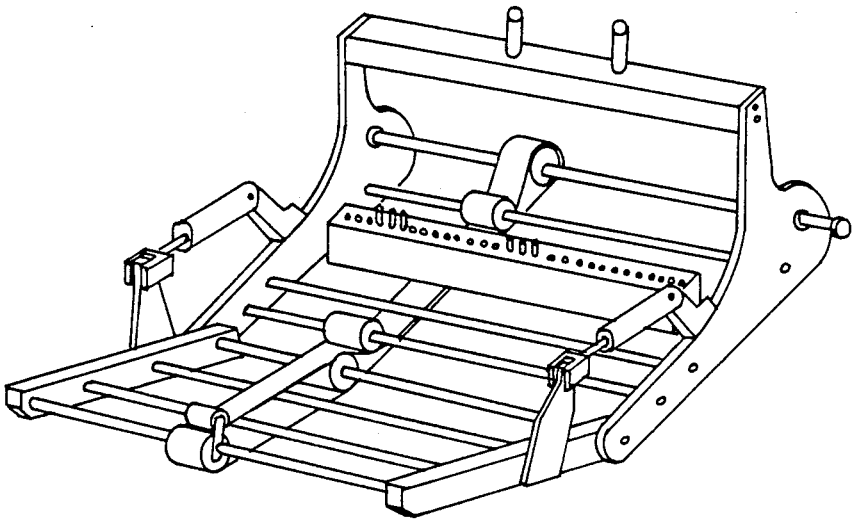
FIG. 5 shows the mechanism of FIG. 4 in an alternative position.

The feed assembly includes a plurality of transversely spaced endless belts, shown generally as 50, the number of such belts depending on the width of the feed plate and the type of workpiece to be handled. Each belt assembly 50 is of similar construction, and for ease of understanding only one such assembly is illustrated in FIG. 4, it being understood that each other assembly is similar thereto. The belt assembly comprises an endless belt 51 having an upper run 52*a*, 52*b* and a lower run 53*a*, 53*b*. The belt passes around a front return roller 54 which is rotatably mounted on the shaft 25 and is tensioned against this return roller by a tensioning roller 55 rotatably mounted between arms 56 which are pivotal on shaft 25. From the front return roller 54 the belt extends to a support roller 57 which is rotatably mounted on the second shaft 56. Both the rollers 54 and 57 engage the inner surface of the upper and lower runs of the belt.

Located behind the roller 57 is a front guide roller 58 rotatably mounted on the third shaft 29 and lying in front of the needle bar 11. The roller 58 engages the outer surface of the upper run of the belt between run sections 52*a* and 52*b*. A rear guide roller 59 is rotatably mounted on the fourth shaft 30 and located behind the needle bar 11, and again the rear guide roller engages the outer surface of the upper run 52*b* of the belt. A rear return roller 60 is mounted behind the guide roller 59 and is secured to rotate with shaft 31. It will be seen that the lower run 53*a*, 53*b* of the belt extends between the front and rear return rollers 54, 60 and lies immediately above the feed table. Part 52*b* of the upper run of the belt extends closely adjacent to the lower run part 53*b* between the guide rollers 58, 59, and is guided by those rollers to pass below the needle bar 11.

The shaft 31 extends beyond the rear section 22 of the first side support and may be connected by a coupling 61 to a drive shaft 62 driven from part of the machine drive housed within the cabinet 2 and bridge 5. The drive is synchronised with the drive to the needle bar and is such that the drive belt 51 is driven so that its lower run advances intermittently from the front towards the rear of the feed mechanism during the intervals when the needle bar is raised so that the needles do not penetrate the workpiece.

In operation, and assuming that the required needles and loopers have been threaded in order to effect stitching in the required regions of a workpiece, the feed mechanism is raised by admission of fluid into the cylinders 47, 48. In addition, the front section of the feed mechanism is pivoted upwardly about the axis of the shaft 26 by retraction of the rams 35 and 40. In this condition the workpiece is arranged on a forward extension 63 of the feed table and aligned as required with the needle bar, with part of the workpiece lying below the raised front section, which facilitates the necessary adjustment. When the workpiece is properly aligned the feed mechanism is lowered by operation of cylinders 47 and 48 and the front section is lowered by extension of the rams 35 and 40. The machine is then driven so that the needle bar reciprocates vertically and the loopers move in synchronism with the needle bar so that the needles penetrate the workpiece and stitches are formed in the workpiece. In addition the conveyor belts are intermittently moved in synchronism with the needle bar so that the fabric is advanced by the required stitch length each time the needles have been raised out of the workpiece. The machine may be controlled to produce any desired stitch length within a given range, and to operate at any desired speed up to a given limit. A range of stitch lengths from 2.5 to 10 stitches per inch and speeds of up to 2,000 stitches per minute are not uncommon in machines of this type, and the feed mechanism is capable of operating within these ranges. The actual stitch length and speed is microprocessor controlled from the control console 4.

A known facility in multi-needle sewing machines is that of positioning needles at different required locations on the needle bar in order to produce different stitching patterns. Obviously, it is necessary that none of the conveyor belts lie immediately below needles, otherwise the belts would become stitched to the workpiece. Accordingly, there is desirably a facility for laterally shifting the belts between the first and second side supports in order to position them in any desired relationship to the needles.

I claim:

1. In a multi-needle sewing machine having a feed table with a plurality of needle holes therein, a needle bar, a plurality of needles mounted on said needle bar, means for effecting vertical reciprocatory movement of said needle bar relative to said feed table, a stitch forming mechanism beneath said feed table and cooperable with said needles to form stitches, and thread feed means for feeding threads to said needles and to said stitch-forming mechinism, the improvement comprising a workpiece feed mechanism having transversely spaced first and second side supports, located respectively beyond opposite ends of said needle bar, a first shaft extending between said side supports at a front region thereof, second, third, fourth and fifth shafts each extending between said side supports parallel to said first shaft, each of said second, third, fourth and fifth shafts being located sequentially further from said front region of said side supports and closer to a rear region of said side supports, a plurality of transversely spaced endless belts each having an upper and a lower run, the lower run lying adjacent to the surface of said feed table and for each belt a front return roller rotatably mounted on said first shaft and engaging the inner surface of said belt, a support roller rotatably mounted on said second shaft and engaging the inner surface of said upper and lower runs of said belt, a front guide roller rotatably mounted on said third shaft and lying in front of said needle bar, a rear guide roller rotatably mounted on said fourth shaft and lying behind said needle bar, a rear return roller mounted on said fifth shaft and engaging the inner surface of said belt, said front and rear guide rollers engaging the outer surface of the upper run of said belt to guide said upper run to lie adjacent to the lower run and below said needle bar, and drive means for driving said belts so that the lower runs thereof travel from the front towards the rear of said side supports.

2. A workpiece feed mechanism as claimed in claim 1 wherein each of said side supports has a front section and a rear section, and means pivoting said front and rear sections together for pivotal movement about the axis of said second shaft, and wherein said first shaft extends between said front sections of said side supports, said third, fourth and fifth shafts extend between said rear sections of said side supports, and means are provided for effecting said pivotal movement.

3. A workpiece feed mechanism as claimed in claim 2 wherein said means for effecting pivotal movement comprise ram means mounted between said front and rear sections of at least one of said side supports.

4. A workpiece feed mechanism as claimed in claim 1 wherein said drive means comprises a motor, transmission means for transmitting drive from said motor to said fifth shaft, means mounting said fifth shaft for rotation relative to said side supports and means coupling said rear return roller to rotate with said fifth shaft.

5. A workpiece feed mechanism as claimed in claim 1 in which at least one of said endless belts, together with its associated front return roller, support roller, front guide roller, rear guide roller and rear return roller is transversely adjustable between said first and second side supports.

* * * * *